United States Patent [19]

Grabbe

[11] Patent Number: 4,917,623

[45] Date of Patent: Apr. 17, 1990

[54] TERMINATOR OF A MULTI-STRAND ELECTRICAL CONDUCTOR

[75] Inventor: Dimitry G. Grabbe, Middletown, Pa.

[73] Assignee: AMP Incorporated, Harrisburg, Pa.

[21] Appl. No.: 242,018

[22] Filed: Sep. 8, 1988

[51] Int. Cl.[4] ..... H01R 13/28

[52] U.S. Cl. ..... 439/284; 439/294; 439/580

[58] Field of Search ..... 439/292–295, 439/289, 333, 349, 350, 364, 370, 372, 378, 379, 443, 580, 583

[56] References Cited

U.S. PATENT DOCUMENTS

| | | | |
|---|---|---|---|
| 2,824,290 | 2/1958 | Archer et al. | 439/294 |
| 3,519,977 | 7/1970 | Swearingen et al. | 339/36 |
| 3,656,092 | 4/1972 | Swengel et al. | 339/213 T |
| 3,708,878 | 1/1973 | Mann et al. | 29/628 |
| 3,742,122 | 6/1973 | Blavos et al. | 339/275 R |
| 3,840,839 | 10/1974 | Smaczny et al. | 439/294 |
| 3,990,765 | 11/1976 | Hill | 439/580 |
| 4,042,775 | 8/1977 | Lin et al. | 339/192 |
| 4,500,980 | 2/1985 | Copeland | 439/284 |
| 4,655,515 | 4/1987 | Hamsher, Jr. et al. | 339/14 R |
| 4,681,382 | 7/1987 | Lockard et al. | 439/92 |
| 4,690,647 | 9/1987 | Hamsher, Jr. et al. | 439/92 |
| 4,737,118 | 4/1988 | Lockard | 439/289 |

*Primary Examiner*—P. Austin Bradley

*Attorney, Agent, or Firm*—James M. Trygg

[57] ABSTRACT

The present invention relates to a termination of a multi-strand electrical conductor carrying relatively high current levels at high frequency in an environment having an ambient temperature of up to about 300° C. The cable is separated into groups of wire strands which are fanned outwardly so that each group projects away from the longitudinal axis of the cable. A retainer is provided to guide the groups of wire strands and to hold them against an annular terminal. The tips of the wire strands and adjacent surfaces of the retainer and the annular terminal are melted into a monolithic fused ring or welded surface, by means of heli-arc welding apparatus. A similar mating connector half is similarly formed, both halves of which mate to form an in-line connector.

20 Claims, 6 Drawing Sheets

TERMINATOR OF A MULTI-STRAND ELECTRICAL CONDUCTOR

The present invention relates to the termination of multi-strand electrical conductors in high power and high frequency applications.

BACKGROUND OF THE INVENTION

When terminating an electrical conductor which is intended to carry relatively high current at relatively high frequency, care must be taken to keep current density at the termination within reasonable limits so that high resistance paths are not inadvertently created. Typically, such high current high frequency applications include high energy pulses for laser devices where the pulse rise time is less than one nanosecond per volt, and induction heating systems and other electromagnetic systems requiring high frequency energy of 10 kilohertz or more.

Such systems may, for example, require continuous current flow of as much as 5,000 amperes with peak demands of 20,000 amperes for short periods of time. Due to short rise time pulses or high frequency alternating current, current flow through the conductor is limited to a portion of the conductor close to its surface. This phenomenon is known in the industry as "skin effect." Additionally, self and mutual inductance of the conductors acts as a choke, further limiting current flow at certain frequencies.

"Skin effect" is the terminology used to describe the tendency for alternating currents to concentrate and flow in the outer region of a conductor. This outer region is defined by the "skin depth" such that, for a circular cross-section, this depth is measured inward from the conductor's surface. Most of the total current flows within this region. Therefore, one finds that the AC resistance of a wire is greater than the DC resistance of that same wire due to the reduced effective cross-sectional area through which the current must pass. The precise value of the skin depth for a circular cross-section is defined as:

$$\text{skin depth} = \frac{1}{\sqrt{\pi f \mu \sigma}}$$

where:

f=frequency $\mu$=permeability $\sigma$=conductivity

Attempts to overcome these problems by utilizing multiple conductors in parallel have met with some success. Multiple insulated conductor strands in close, parallel proximity exhibit about a 50% reduction of inductance over a single strand conductor. Such multi-strand conductors, now commercially available, are typically composed of thousands of very small diameter wires, each of which is insulated by a thin coating of varnish such as polyimide, or some other insulating material such as epoxy.

Such multi-strand cables being used for the transmission of high frequency and high current energy, are often subjected to high ambient temperatures due to the nature of the devices utilizing the transmitted energy. Induction heating systems, for example, frequently produce an ambient temperature near the power cable of about 300° C. This relatively higher temperature causes a decrease in conductivity which, in turn, causes an increase in the skin depth. For example, using a copper conductor and current at 10 kHz, a change from room temperature to 300° C. will result in about a 45% increase in skin depth.

Connectors for removably connecting these cables to their respective equipment must, therefore, be able to transmit the high frequency, high current energy without imposing high resistance paths.

One current practice of terminating a multi-strand conductor is to solder the conductor to a terminal. This results in a rather long section of the cable being saturated by the solder which reduces the length of uninsulated wire strands, making them, in effect, into a single conductor with higher inductance, yielding a high resistance path for the AC current. This occurs because a chemical solution is used to strip the insulation from the individual strands of the conductor, and due to capillary action, the solution is carried far into the bundle of twisted wire strands. Similarly, the solder is drawn into the bundle of strands to the extent of the stripped wire. Another current practice is to fuse the ends of the bundle of strands to an adjacent terminal. This solves the problem of a solder saturated cable, but still results in a high resistance path at the fused junction of the wire strand ends and the terminal because of the aforementioned "skin effect" phenomenon of the limited area of contact. Examples of such terminations are disclosed in Swengel Sr. et al. U.S. Pat. No. 3,656,092 which issued Apr. 11, 1972, and Lin et al. U.S. Pat. No. 4,042,775 which issued Aug. 16, 1977. Such terminations work well for D.C. or low frequency applications, however, at high frequencies, due to skin effect, the cross-sectional area available for current flow is reduced. This is known in the industry as constriction resistance.

What is needed is a termination for connecting multi-strand cables to their respective equipment in high frequency, high current, and high temperature applications without adversely affecting current flow by constriction.

SUMMARY OF THE INVENTION

The present invention relates to a terminator or removable connector of a multi-strand electrical conductor for conducting high current levels at high frequency and high ambient temperature The multi-strand conductor has a longitudinal axis and a plurality of groups of strands. A terminal having a wire terminating surface is provided along with a receiver means. The receiver means receives and directs some of the plurality of groups of strands outwardly from the axis and distributes the ends of the strands along the wire terminating surface. A fusion of metal is provided along the ends of the strands and a portion of the wire terminating surface to form a monolithic fused structure. This fanning out of the groups of strands effects a larger terminating area for conducting current thereby obviating the effect of constriction.

DESCRIPTION OF THE PREFERRED EMBODIMENT

Figure 1:
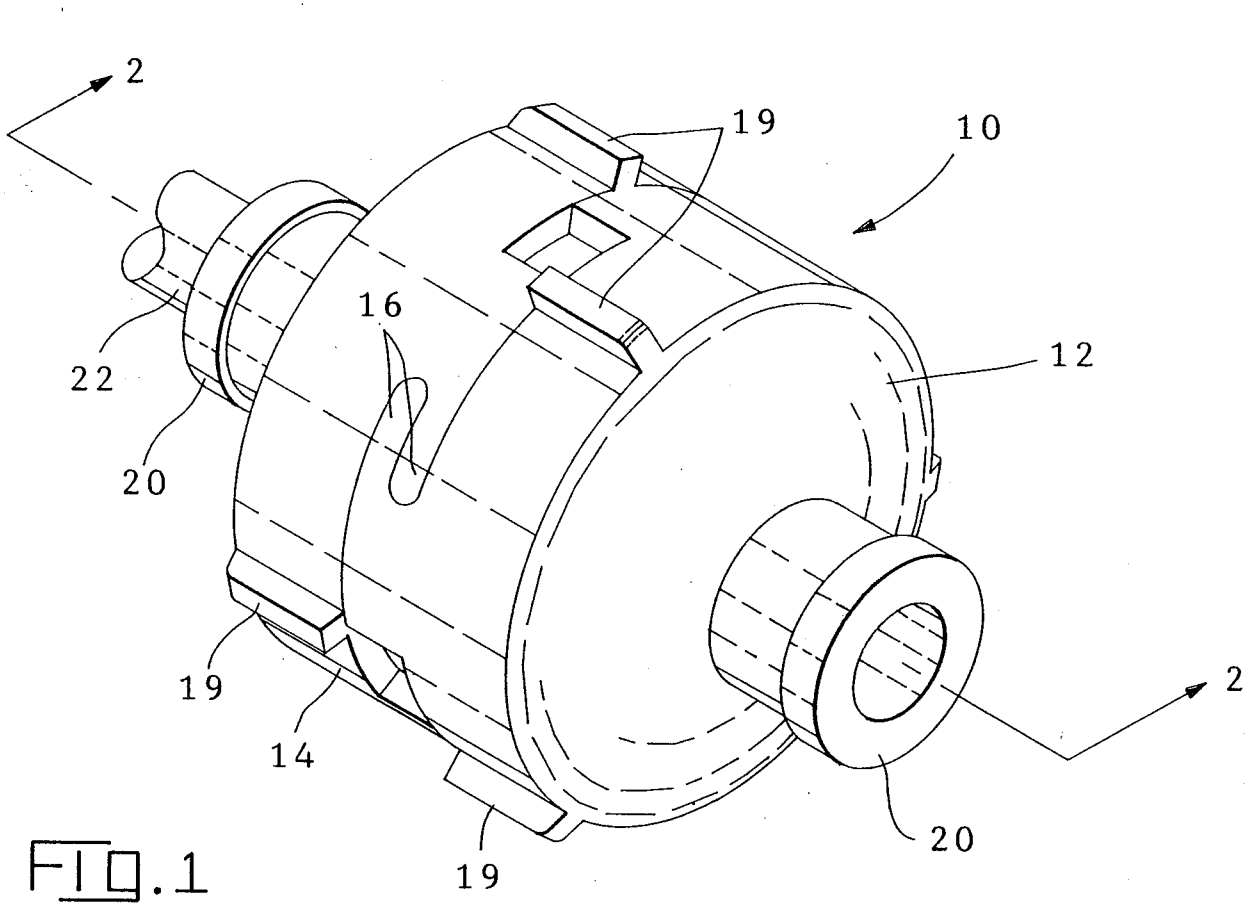
FIG. 1 is an isometric view of an in line connector.
Figures 2, 2A:
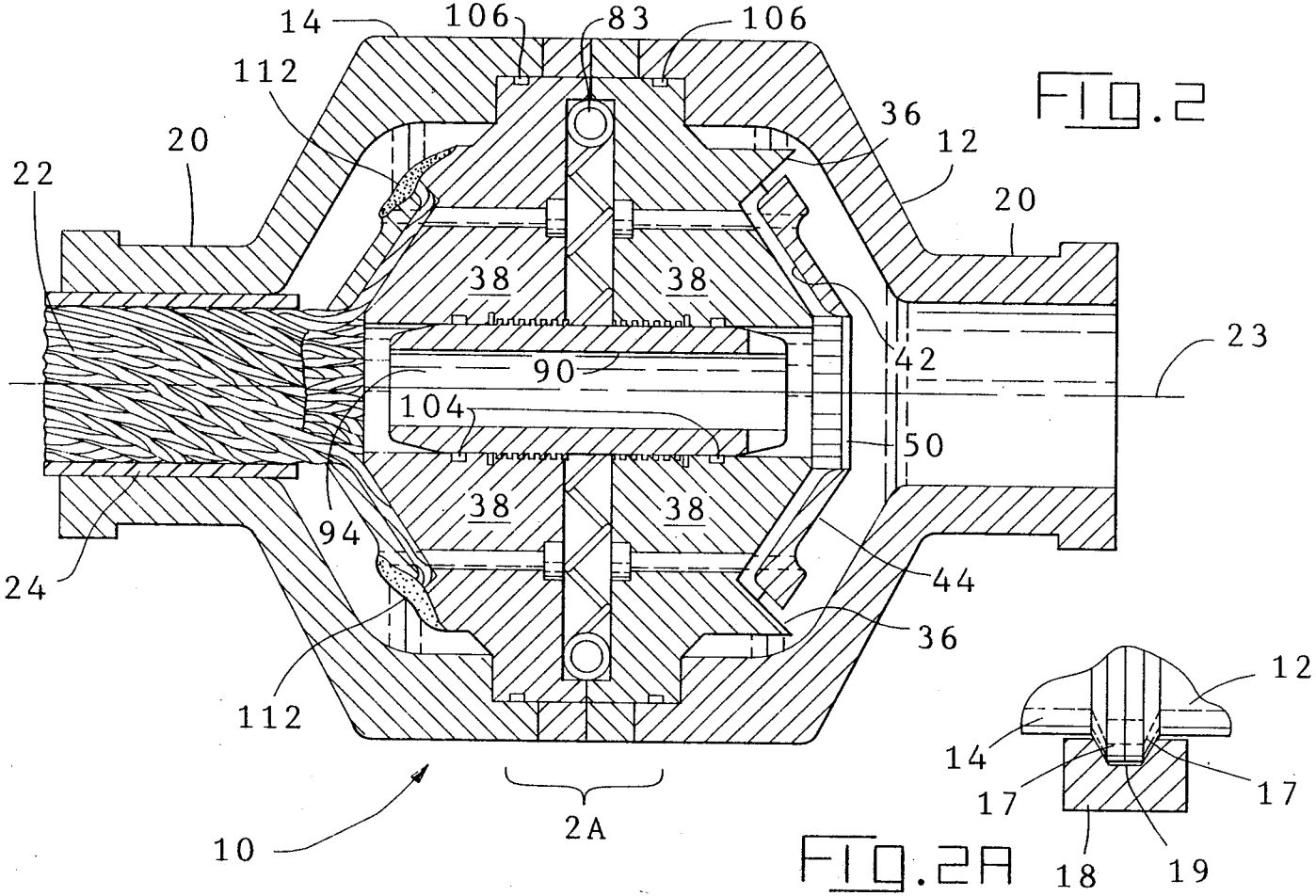
FIG. 2 is a cross-sectional view of the connector of FIG. 1 taken along the lines 2—2, incorporating the teachings of the present invention.
FIG. 2A is a cross-sectional view of a portion of the connector identified as 2A in FIG. 2 showing an alternative structure.

There is shown in FIG. 1 an in-line connector 10 having a right housing half 12 and a left housing half 14 which are in interlocking engagement by means of the mutually interlocking fingers 16. While the two housing halves 12 and 14 are identical, in the present example, they may be made somewhat different to satisfy the needs of a particular application without departing from the teachings of the present invention. An alternative structure for interlocking the two housing halves 12 and 14 into operational engagement is shown in FIG. 2A. The housing halves each have a beveled flange 17 in place of the interlocking fingers 16. A peripheral clamp 18 has an interior groove 19 which cams the beveled flanges 17 together. The clamp 18 is a two piece split ring structure which is toggled or bolted together to effect the desired clamping action. The actual structures of the interlocking fingers 16 or beveled flanges 17 of the housing halves 12 and 14 are unimportant to the practice of the present invention and are, by way of example, illustrative of structures that are suitable to employ the teachings of the present invention. The housing halves 12 and 14 must be made from a material that will not weld at 300° C., such as passivated stainless steel. This will help to assure that the connector 10 can be separated after being in use. Wrench lugs 19 are spaced about the periphery of the housing halves 12 and 14, as is common in the industry, to facilitate assembly and disassembly of the two halves. Each housing half 12 and 14 includes a strain relief portion 20 for receiving a multi-strand cable 22. To enhance clarity, the cable 22 is shown only with respect to the left housing half 14 in the figures. It will be understood, however, that the teachings of the present invention may be advantageously practiced with respect to both housing halves 12 and 14 and with the termination of cables directly to the power receiving apparatus.

Figure 3:
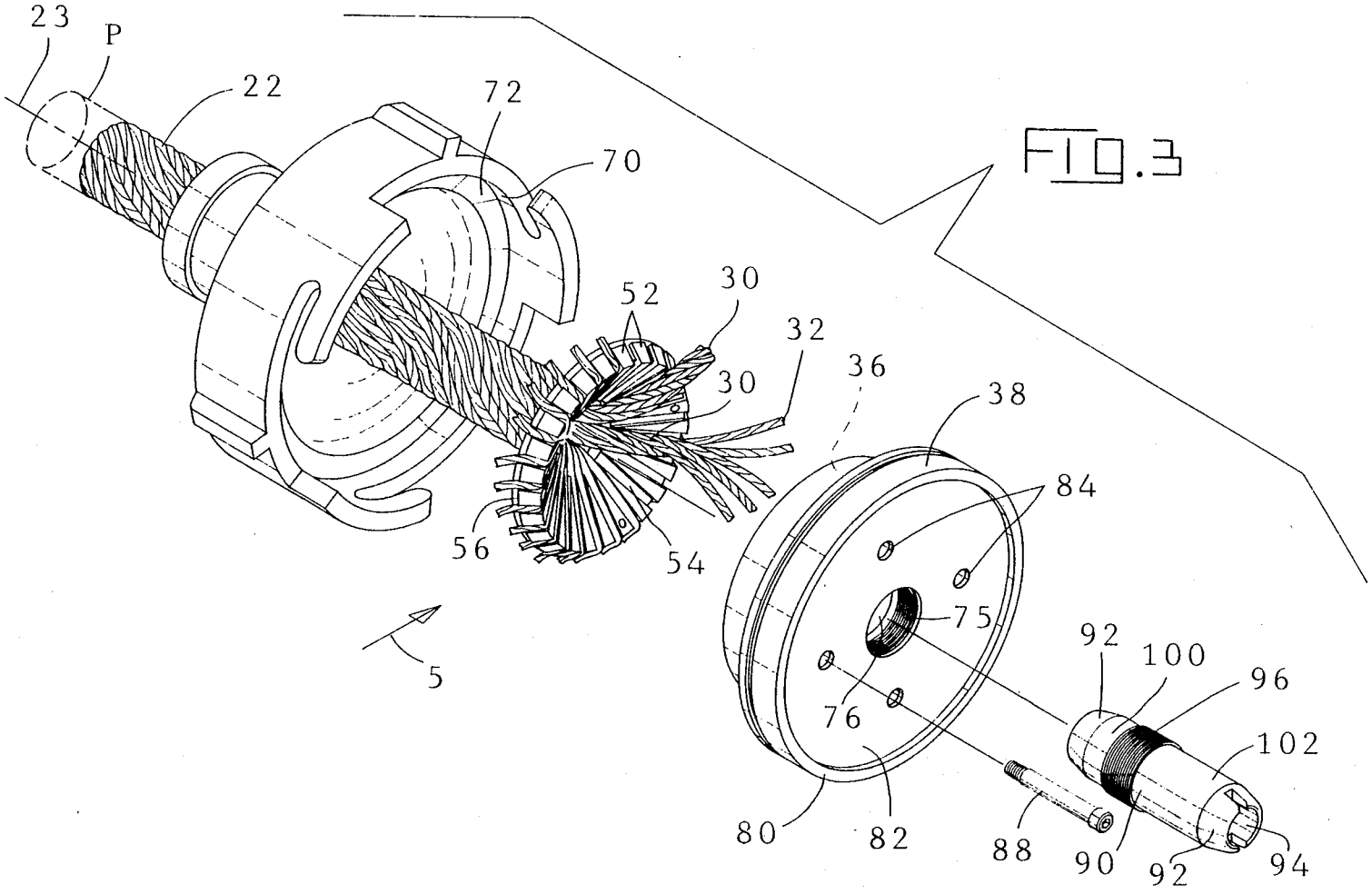
FIG. 3 is an exploded parts view of a portion of the connector shown in FIG. 2.
Figure 4:
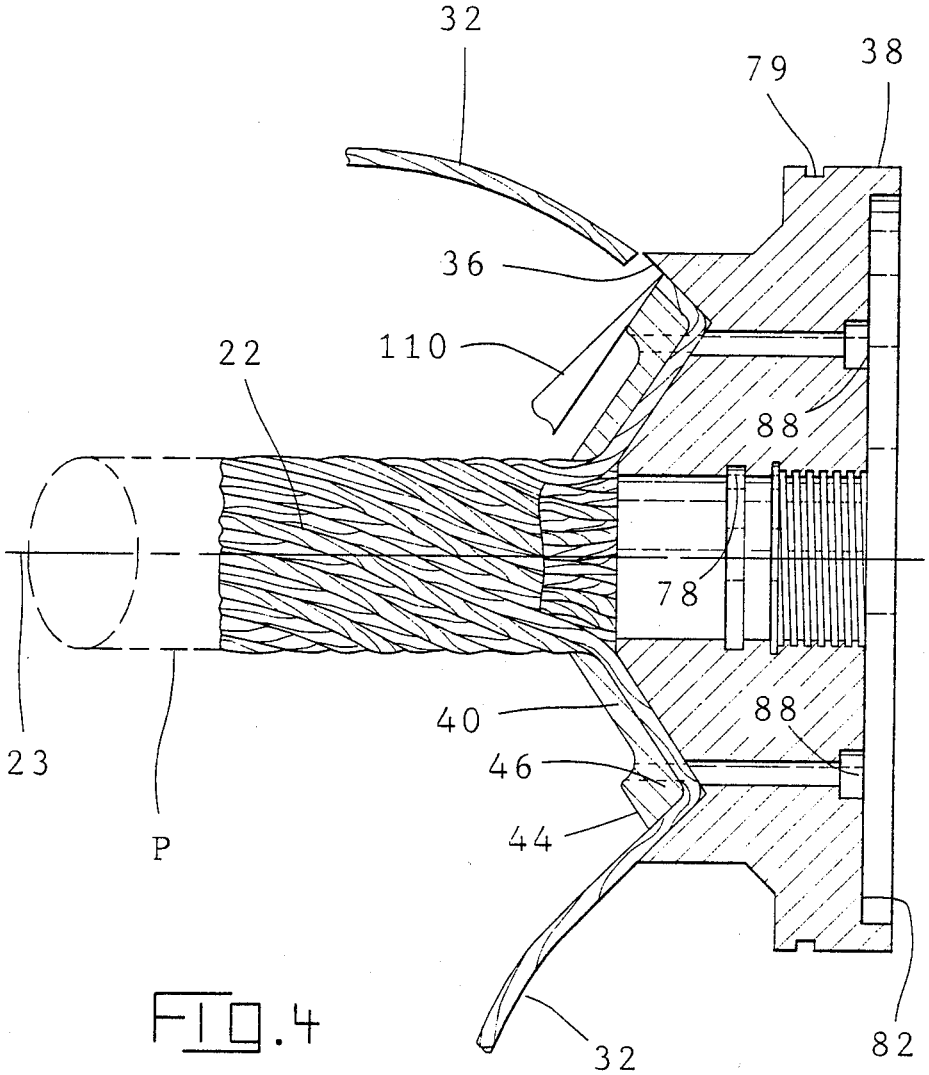
FIG. 4 is a partial cross-sectional view similar to that of FIG. 2 showing the termination in a partially completed state.

The connector 10, embodying the teachings of the present invention, is more clearly shown in FIGS. 2, 3, and 4. The multiconductor cable 22 having a longitudinal axis 23 includes an outer insulating and protective covering 24 which is shown in FIG. 2, but is omitted from the other figures. The cable 22 having an outer periphery P, is composed of a plurality of twisted bundles 30, each of which is composed of a number of twisted groups 32 of wire strands, as best seen in FIGS. 3 and 4. Typically, there are about 7 such bundles in a one inch diameter cable, each bundle consisting of about 5 groups, and each group containing about 1000 strands of about 0.010 inch diameter wire. Each such strand includes an insulating coating of varnish such as polyimide or a coating of some other insulating material such as epoxy.

In an ambient temperature of about 300° C. and a requirement to conduct, for example, about 10,000 amperes at a frequency of above 10 kilohertz, the conventional crimped termination would be inadequate. In order to conduct such high current under these conditions, an area is required which would permit placement of a sufficient number of contacts, side by side, each carrying approximately 14 amperes, to satisfy the total current requirement.

The present invention accomplishes this by fanning out the individual groups 32 of wire strands and placing them in contact with a peripheral wire terminating surface 36 of a terminal 38. The wire terminating surface 36, in the present example, is an annular surface having a center of revolution that is approximately coincident with the longitudinal axis 23 of the cable 22. It is important that the wire terminating surface 38 be spaced from the longitudinal axis 23 a greater distance than is the periphery P of the cable 22. That is, the tips of the wire strands are fanned out beyond the periphery P to contact a greater area than would otherwise be available. This provides sufficient contacting surface area to assure low current density across the entire wire terminating surface 36 thereby lessening the effect of constriction.

Figure 5:
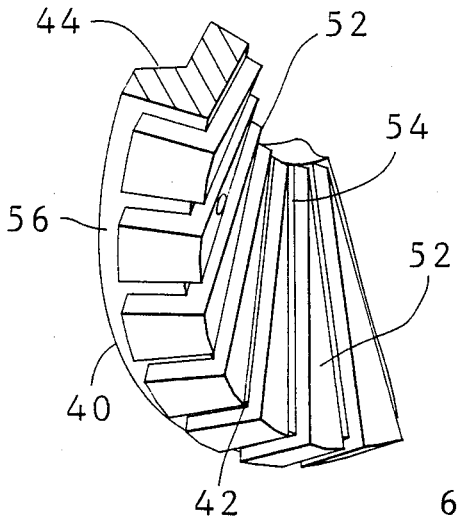
FIG. 5 is a partial isometric view of the portion of FIG. 3 indicated by the arrow 5.
Figure 6:
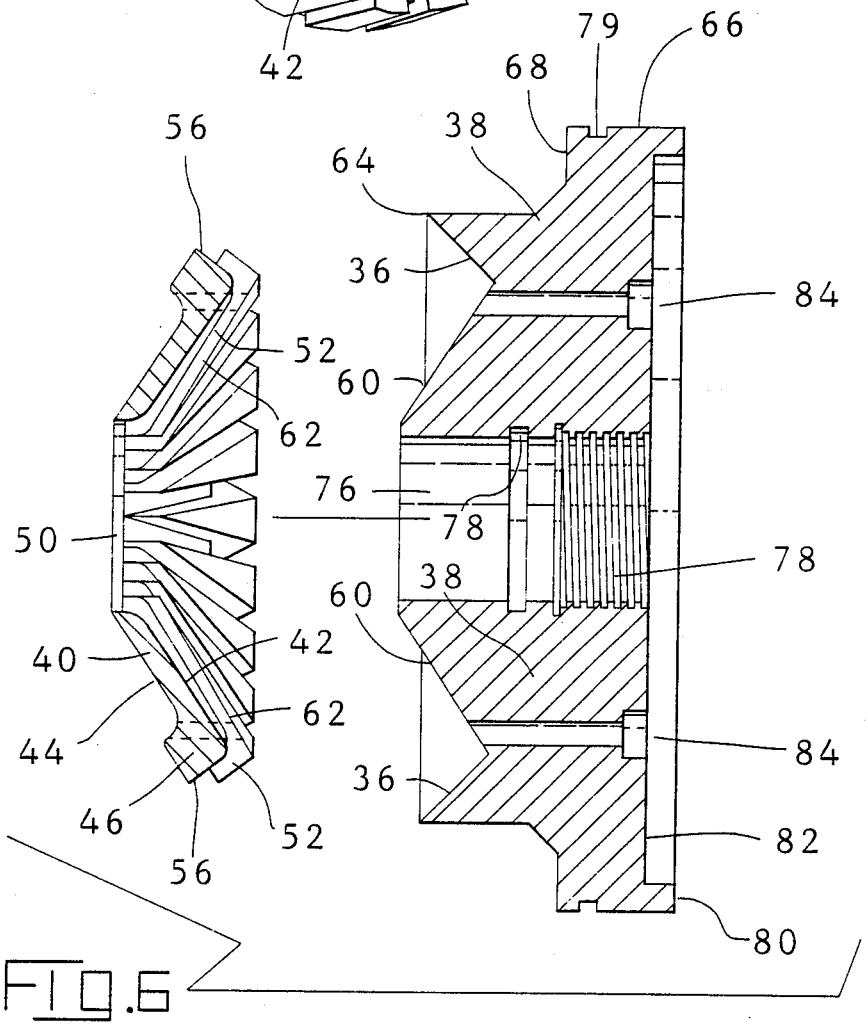
FIG. 6 is a cross-sectional view of the retainer and terminal similar to that of FIG. 2.

As best seen in FIG. 3 and 4, a retainer 40 is arranged to cooperate with the terminal 38 to direct the groups 22 of fanned out wire strands to the wire terminating surface 36. The retainer 40, which is preferably made of copper, is of conical shape having an inner surface 42 and an outer surface 44 that diverges from the inner surface 42 near the periphery. This provides a somewhat thickened cross-sectional portion 46, as best seen in FIGS. 4 and 6. The retainer includes a central perforation 50, shown in FIG. 3, as well as a number of guide rails 52 which are disposed on the inner surface 42 and extend radially outwardly to form channels 54 therebetween . As is shown in FIGS. 3 and 5, the rails 52 extend out to and around a portion of the peripheral surface 56 of the retainer 40.

The terminal 38, which is preferably made of copper, includes a conical surface 60 adjacent the wire terminating surface 36 shaped to mate with the edges 62 of the rails 52. Note that the wire terminating surface 36 tapers outwardly, as viewed in FIG. 6, to a somewhat featheredge 64 which serves to supply filler material during welding of the wire strands to the wire terminating surface 36, as will be explained below. This featheredge 64 also serves as a convenient anvil against which the wire strands of the cable 22 are cut, as will be explained in more detail below. An outer diameter 66, of the terminal 38, adjacent a shoulder 68 is sized to slip into the interior diameter 70 of either of the connector housing halves 12 and 14, the shoulder 68 abutting the shoulder 72 of the respective housing half, as seen in FIGS. 2 and 3. The terminal 38 includes a central bore 76 having an internal threaded portion 75 at an end opposite the conical surface 60. The central bore 76, outer diameter 66, conical surface 60, and wire terminating surface 36 are all substantially concentric about a common axis which is coincident with the axis 23 when assembled as shown in FIG. 2. A pair of grooves 78 and 79 are formed in the central bore 76 and outer diameter 66 respectively of the terminal, as best seen in FIG. 4, for a purpose that will be explained below. An abutting face 80 is disposed on the terminal 38 opposite to and parallel with the shoulder 68. A contacting surface 82 is undercut in the face 80 for containing an array 83 of contacts, which provides the contacting means or principal current conducting path between the terminal 38 located in the left housing half 14 and a similar terminal 38 located in the right housing half 12.

Figure 7:
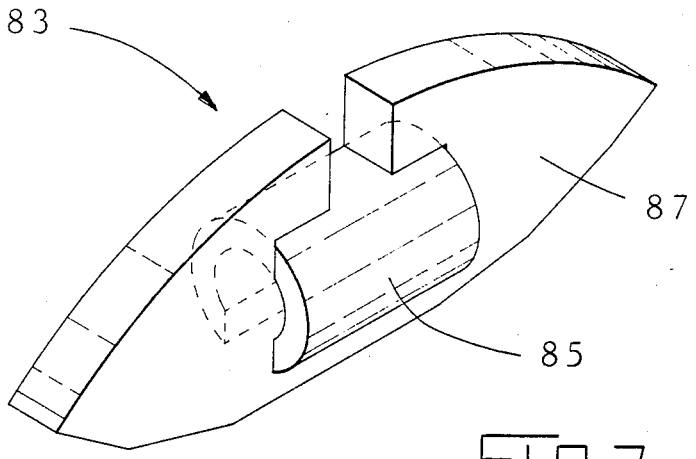
FIGS. 7 and 8 are isometric views showing two embodiments of the array of contacts.
Figure 8:
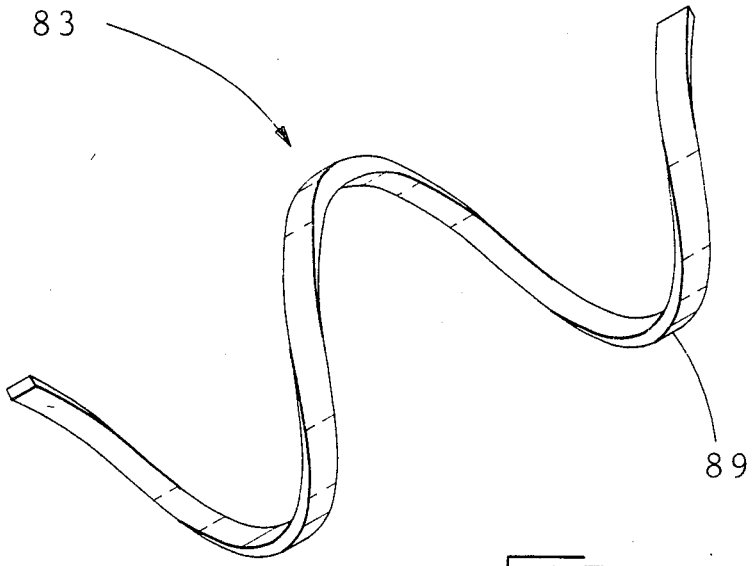

There are several contact structures commonly used in the industry that would be suitable for use. For example, C-shaped metal segments 85 held in an annular array by a retaining ring of thin metal disk 87 as shown in FIG. 7, or a coil spring 89 made of wire having a rectangular cross section and wound in an open helical pattern similar to that of a compression spring, as shown in FIG. 8. The segment 85 or spring 89 should be made of a high temperature spring material such as beryllium nickel or a suitable steel alloy. The only requirement is that the contacts be made of a material that will retain its resiliency and not weld to the terminal 38 at 300° C. under normal contact pressures. The contacting surfaces 82, preferably include a deposited layer of silver and cadmium oxide having a thickness of about 0.03 inches. The silver content of this layer should be between about 70% and about 90%. Such a layer, not shown, will provide excellent electrical conductivity at the points of engagement with the contacts of the array 83. Additionally, a similar layer of silver and cadmium oxide may be deposited on the outer surface of both of the coil spring 89 and the C-shaped segments 85 to further enhance conductivity at the points of engagement.

Counterbored bolt holes 84 are formed through the terminal 38 and match corresponding threaded holes formed in the retainer 40. This permits bolting the terminal 38 and retainer 40 together with the bolts 88 as shown in FIG. 4. Note that the rails 52 are brought into contact with the conical surface 60 thereby enclosing the channels 54. The terminals 38 shown in the two connector halves 12 and 14, in the present example, are substantially identical as are the two retainers 40. However, differences in these respective parts may be required for a particular application, and would be deemed to not depart from the teachings of the present invention.

A hollow pin 90, as shown in FIGS. 2 and 3, is provided with beveled ends 92, a central hole 94, and a threaded portion 96 of a greater diameter than that of the pin 90. The diameter of the pin 90 is sized to snuggly slip into the central bore 76 of the terminal 38. The threaded portion 96 is disposed slightly off center but concentric with the diameter of the pin 90 so that the pin 90 has a short guide shank 100 and a long guide shank 102. The short guide shank is inserted into the bore 76 of the terminal 38 contained in the left housing half 14, and then screwed into tight threading engagement with the threaded portion 75. The long guide shank 102 then projects outwardly along the axis 23 and will receive and align the bore 76 of the terminal 38 contained in the right housing half 12 when assembling the two connector halves. The pin 90 serves to align the two connector halves prior to engagement of both the contacts, not shown, and the interlocking fingers 16. When the connector halves are disconnected, the pin 90 remains captive in the left terminal 38, as viewed in FIG. 2. This permits relatively easy assembly and disassembly of the connector 10.

The central hole 94 of the pin 90 provides a passage way between the two halves of the connector 10 so that a cooling gas, such as nitrogen or air, may pass. The cooling gas is injected into the cable 22 at a remote location, not shown, and circulated throughout the cable 22 and connector 10. An O-ring 104 is disposed within the groove 78 in engaging contact with the outer diameter of the pin 90 to prevent loss of cooling gas through the space between the contacting surfaces 82 and into the ambient atmosphere. Similarly, an 0-ring 106 is disposed within the groove 79 in engaging contact with the interior diameter 70 of the housing half 12, 14 to prevent loss of cooling gas through the space between the interlocking fingers 16. Both 0-rings 104 and 106 must be made of a suitable material to withstand a working temperature of 300° C., such as, for example, polytetrafluoroethylene which is distributed under the trade name "Teflon" by E. I. duPont de Nemours & Company, Wilmington, Del. Such use of a cooling gas is well known in the industry and, therefore will not be described further here.

The actual assembly and welding of the cable 22 to the terminal 38 is best illustrated in FIGS. 2, 3, and 4. The outer covering 24 of the cable 22 is first stripped for a suitable length. The stripped end is then inserted through the strain relief 20 of the left housing half 14 and through the central perforation 50 of the retainer 40. The cable 22 is then separated into the individual bundles 30 and each bundle further separated into the individual groups 32. The groups 32 of strands of wire are then fanned outwardly from the axis 23 so that each group 32 extends outwardly on a unique radial beyond the periphery P of the cable 22. The groups 32 are then placed into the channels 54, one group into each channel. The wire strands of each group are bent approximately 90 degrees over the peripheral surface 56 as shown in FIG. 3. The retainer 40 and terminal 38 are then carefully brought together so that the rails contact the conical surface 60 and wire terminating surface 36 without trapping loose strands of wire therebetween. The two parts are then bolted together by means of the bolts 88 which are intended to hold the assembly together until the welding operation is completed as described below.

As shown in FIG. 4, excess lengths of the groups 32 of wire strands are trimmed flush with the outer surface 44 of the retainer 40. This is easily accomplished by cutting the wires with a sharp blade 110, against the wire terminating surface 36. The blade of a common pocket knife will work well, however, any sharp cutting blade will be suitable.

After all groups 32 are trimmed flush with the outer surface 44, the assembly is then suitably clamped to a welder's table. A heli-arc welding apparatus is then used to melt the featheredge 64, a portion of the tips of the wire strands of the groups 32, and a portion of the surface 44 near the peripheral surface 56. The melting of the featheredge 64 and surface 44 provides sufficient volume of molten copper to fill the voids between the strands of wire near their ends so that a dense continuous weld surface 112 is formed, as best seen in FIG. 2.

By way of background, the heli-arc method of welding is an old, well established technology. The heli-arc apparatus typically includes a water cooled gun containing a tungsten electrode. The tip of the electrode is brought sufficiently close to the metal to be welded so that an arc is drawn in the gap therebetween. The gap and surrounding area are flooded with helium or argon, or some other noble gas, to prevent oxidation of the material being welded.

During the welding process, in the present case, as the tips of the wire strands of the groups 32 melt and fuse, the featheredge 64 and the surface 44 will melt and merge with the wire tips into a monolithic fused ring or welded surface 112. It will be appreciated by those skilled in the art that in the intensive heat of the arc, the polyimide insulating the wire strands will sublime or boil off, since it cannot burn under the protective blanket of helium, argon, or other noble gas. Since this welding process can be completed quickly, in about 30 seconds, the heat generated in the wire strands will be carried away due to heat sinking into the bulk of the retainer 44 and terminal 38 thereby protecting the polyimide insulation immediately below the weld mass.

When the connector 10 is coupled into operational engagement, the two housing halves 12 and 14 are brought together with the array 83 of contacts disposed within the cavity formed by the two undercuts. As the interlocking fingers 16 begin to lockingly engage, the contacts of the array 83 engage the two contacting surfaces. Relative twisting of the two housing halves 12 and 14 cause a camming action by the fingers 16 to slightly compress the array 83 of resilient contacts until the abutting faces 80 are forced into abutting contact. The amount of compression of the contacts is easily controlled by controlling the depth of the undercut in the face 80 and thereby the distance between the two parallel opposing contacting surfaces 82. This permits designing the resilient contact, the segment 85 or the coil spring 89, with a suitable force/deflection curve or spring rate which enables the structure of the contact to be "closed loop" thereby minimizing self-inductance.

A very important advantage of the present invention is the uncomplicated manufacturing requirements due to the simplicity of the structure and of the heli-arc welding method of making the electrical contact between the tips of the wire strands and the wire terminating surface of the terminal. Further, a connector, in accordance with the teachings of the present invention will withstand the hostile environments of applications requiring relatively high current delivery at high frequency in a high temperature environment.

I claim:

1. A terminator of a multi-strand electrical conductor for conducting high current levels at high frequency and high temperature, said conductor having a longitudinal axis and an outer periphery substantially concentric thereto, said terminator comprising:

(a) a plurality of groups of strands of said multi-strand conductor wherein each of said strands includes a layer of insulating material insulating it from adjacent strands;

(b) a terminal having a wire terminating surface;

(c) receiver means for receiving and directing some of said plurality of groups of strands outwardly from said axis and distributing ends of some of said strands along portions of said wire terminating surface which are further from said longitudinal axis than is said outer periphery; and (d) a fusion of metal along said ends of said strands and a portion of said wire terminating surface into a monolithic fused structure.

2. The terminator according to claim 1 wherein said terminal includes means for electrical connection thereof to a separate electrical device.

3. The terminator according to claim 2 wherein said wire terminating surface is substantially concentric with said outer periphery of said cable.

4. The terminator according to claim 3 wherein one of said terminal and said receiver means include a shearing edge for shearing said ends of said strands in conformance to said portion of said wire terminating surface.

5. The terminator according to claim 4 wherein a portion of said shearing edge is a portion of said fusion of metal.

6. The terminator according to claim 5 wherein said terminal is one half of a connector and said separate electrical device is another one half of a connector mating therewith.

7. The termination according to claim 6 wherein said terminal includes an outwardly sloping surface of revolution having an axis substantially in alignment with said longitudinal axis of said multi-strand electrical conductor, said outwardly sloping surface terminating substantially at said wire terminating surface.

8. In an electrical connector for high power, high frequency, and high temperature application, said connector having an axis, an opening directing a multi-strand electrical conductor along said axis, said conductor having a longitudinal axis and a periphery substantially concentric thereto and being composed of a plurality of groups of strands, (a) a terminal having a wire terminating surface;

(b) receiver means for receiving and directing some of said plurality of groups of strands outwardly from said axis and distributing ends of said strands along portions of said wire terminating surface that are further from said axis than is said cable; and (c) a fusion of metal along only said ends of said outwardly directed strands and said portions of said wire terminating surface into a monolithic fused structure wherein each of said strands includes an insulating layer on its outer surface extending to within about 0.1 inches or less of said fused structure.

9. The connector according to claim 8 wherein one of said terminal and said receiver means includes a shearing anvil for shearing said ends of said strands so that said ends lie upon said wire terminating surface.

10. The connector according to claim 9 wherein said receiver means includes a plurality of channels which project radially outwardly from said axis, each of some of said channels containing a different one of said plurality of groups of strands.

11. The connector according to claim 10 wherein said plurality of channels are substantially equally spaced about an opening through which said plurality of groups of strands pass.

12. The connector according to claim 11 wherein said receiver means is attached to said terminal so that each of said plurality of channels terminates at said wire terminating surface.

13. The connector according to claim 12 wherein said fusion of metal includes a portion of said receiver means.

14. An electrical connector for releasably connecting two multi-strand electrical conductors together for carrying relatively high current at frequency in a high temperature environment, comprising:

(a) a connector housing having a longitudinal axis and a pair of openings directing said two conductors in opposing relation along said axis, each of said conductors being composed of a plurality of groups of strands;

(b) a pair of terminals each having a contacting surface and a wire terminating surface, said terminals arranged within said housing with said contacting surfaces spaced a predetermined distance apart in parallel opposing relation;

(c) contact means for providing a current path between said two contacting surfaces;

(d) receiver means for receiving and directing some of said plurality of groups of strands outwardly from said axis and distributing ends of said strands along portions of said wire terminating surface that are further from said axis than is said cable; and (e) a fusion of metal along only said ends of said outwardly directed strands and said portions of said wire terminating surface into a monolithic fused structure wherein each of said strands includes an insulating layer on its outer surface extending to within about 0.1 inches or less of said fused structure.

15. The connector according to claim 14 wherein said receiver means is attached to said terminal and includes a plurality of channels which project radially outwardly from said axis and terminate at said wire terminating surface, each of some of said channels containing a different one of said plurality of groups of strands.

16. The connector according to claim 15 wherein said pair of terminals are substantially identical in shape and size.

17. The connector according to claim 16 wherein said housing comprises a pair of substantially identical half housings and includes locking means for releasably locking said pair of half housings into mutual operational engagement.

18. The connector according to claim 17 including an abutting face on each of said terminals adjacent its respective contacting surface so that when said housing halves are in said mutual operational engagement, said abutting surfaces are in abutting engagement and said contacting surfaces are thereby spaced apart said predetermined distance.

19. The connector according to claim 18 wherein each of said contacting surfaces of said terminals includes a layer of material comprising between about 70% and about 90% silver and not more than about 30% cadmium oxide, and said contact means comprising an array of contacts disposed between and in current conducting engagement with both of said opposed contacting surfaces, said array of contacts being resiliently compressed therebetween.

20. The connector according to claim 19 wherein said array of contacts comprises a wire of rectangular cross section formed in an open helical pattern.

* * * * *

UNITED STATES PATENT OFFICE

CERTIFICATE OF CORRECTION

Patent No. 4,917,623 Dated April 17, 1990

Inventor(s) Dimitry G. Grabbe

It is certified that error appears in the above-identified patent and that said Letters Patent is hereby corrected as shown below:

In claim 7, column 8, line 8, the word "termination" should be --terminator--.

Signed and Sealed this

Third Day of March, 1992

*Attest:*

HARRY F. MANBECK, JR.

*Attesting Officer*

*Commissioner of Patents and Trademarks*